US005154816A

United States Patent [19]

Martinou et al.

[11] Patent Number: 5,154,816

[45] Date of Patent: Oct. 13, 1992

[54] PROCESS FOR DEPOSITING AN ANTI-WEAR COATING ON TITANIUM BASED SUBSTRATES

[75] Inventors: Robert L. Martinou, Bry S/Marne; Michel M. Ruimi, Paris, both of France

[73] Assignee: Societe Nationale D'Etude et de Construction de Moteurs D'Aviation "S.N.E.C.M.A.", Paris, France

[21] Appl. No.: 736,381

[22] Filed: Jul. 26, 1991

[30] Foreign Application Priority Data

Jul. 26, 1990 [FR] France ..... 90 09554

[51] Int. Cl.[5] ..... C23C 28/00; C25D 5/34

[52] U.S. Cl. ..... 205/176; 205/170; 205/180; 205/186; 205/206; 205/212; 205/917

[58] Field of Search ..... 205/170, 176, 180, 181, 205/186, 191, 206, 212, 917

[56] References Cited

U.S. PATENT DOCUMENTS

| | | | |
|---|---|---|---|
| 3,497,426 | 2/1970 | Okamura | 205/186 |
| 4,604,168 | 8/1986 | Liu et al. | 205/186 X |
| 4,632,734 | 12/1986 | Mix | 205/170 |
| 4,904,352 | 2/1990 | Witte | 205/212 X |
| 4,919,773 | 4/1990 | Naik | 205/170 |
| 4,931,152 | 6/1990 | Naik | 205/191 |
| 4,938,850 | 7/1990 | Rothschild et al. | 205/212 X |

FOREIGN PATENT DOCUMENTS

| | | |
|---|---|---|
| 0155611 | 9/1985 | European Pat. Off. . |
| 0186266 | 7/1986 | European Pat. Off. . |
| 0188057 | 7/1986 | European Pat. Off. . |
| 1322970 | 2/1963 | France . |

OTHER PUBLICATIONS

John L. Vossen et al, Thin Film Processes, Academic Press, New York, 1978, pp. 11-24.

Plating & Surface Finishing, vol. 75, No. 2, Feb. 1988, pp. 71-75, T. G. Beat, et al., "Plating on Molybdenum".

*Primary Examiner*—John Niebling

*Assistant Examiner*—William T. Leader

*Attorney, Agent, or Firm*—Oblon, Spivak, McClelland, Maier & Neustadt

[57] ABSTRACT

A process for depositing an anti-wear coating on a titanium-based substrate comprises:

a) roughening the substrate by sanding;

b) deposition of a keying nickel sub-layer on the substrate by cathodic spraying (cathode sputtering);

c) intermediate cleaning;

d) activation of the cleaned part by immersion of the part in a cyanide bath;

e) electrolytic deposition of nickel; and f) deposition of a final, anti-wear layer of a material selected from the group consisting of Ag, Cr, Ni, Co, and mixtures thereof, with or without ceramic particles such as SiC, $Cr_2C_3$, $Al_2O_3$, $Cr_2O_3$.

12 Claims, 2 Drawing Sheets

PROCESS FOR DEPOSITING AN ANTI-WEAR COATING ON TITANIUM BASED SUBSTRATES

BACKGROUND OF THE INVENTION

1. Field of the Invention

The present invention relates to the deposition of anti-wear coatings on titanium or titanium alloy parts, and the coated parts thus obtained.

2. Summary of the Prior Art

It is very difficult to obtain very adherent deposits on titanium and titanium alloy parts because of their high passivitiy.

It has already been proposed to subject such parts to be coated to a preliminary treatment before proceeding with the deposition of the actual anti-wear coating, so as to improve the adherence of the latter. Examples of the preliminary treatments which have been proposed are:

Anodic attack in mixtures of glycol—hydrofluoric acid, acetic acid;

Predeposition of zinc from glycol—metal fluoride mixtures, or aqueous mixtures based on fluoroboric, hydrofluoric acids and metal salts;

Long duration pickling in concentrated hydrochloric or sulphuric-hydrochloric acids, followed by deposition of iron, nickel or cobalt in a very acidic bath.

In all of these methods it is necessary or recommended to combine the preliminary treatment with a thermal treatment between 400° C. and 800° C. in an atmosphere which does not contaminate titanium, in order to improve the firmness of the metal coating. However, this firmness is never excellent. In particular, the coating obtained does not withstand machining or finish-grinding.

It has also been proposed in FR-A-1 322 970 to carry out a preliminary chemical treatment in an oxidixing medium, which comprises subjecting the part to the action of a bath of chromic anhydride, alkaline phosphate and hydrofluoric acid for from 5 to 30 minutes at a temperature between 35° C. and 100° C. However this treatment has the double drawback of generating hydrides in the coating and effecting an undesirable penetration of hydrogen into the substrate during subsequent electrolytic operations.

It is therefore an object of the invention to be free of the above-mentioned drawbacks by doing away with preliminary chemical treatments of the substrate, thereby avoiding the production of hydrides and curbing the penetration of hydrogen into the substrate during the electrolytic process of depositing the anti-wear coating.

It is also an object of the invention to enable an anti-wear coating to be deposited on titanium parts while reducing fatigue failure compared to the known processes, thus permitting the use of coated titanium substrates for parts subjected to cyclic fatigue, where such parts obtained by the known processes would not be acceptable.

A further object of the invention is to achieve a deposition sequence in which the technique of nickel deposition by magnetron cathodic spraying (cathode sputtering) so as to obtain a particularly adherent sub-layer on the substrate is associated with an electrolytic deposition permitting the deposition of a final anti-wear coating.

Yet another object of the invention is to define parameters for the deposition of nickel by cathodic spraying, compatible with subsequent electrolytic depositions.

SUMMARY OF THE INVENTION

According to the invention a process for depositing an anti-wear coating on a titanium-based substrate comprises the steps of:

a) roughening the substrate by sanding;

b) deposition of a keying nickel sub-layer on the substrate by cathodic spraying;

c) intermediate cleaning of the part obtained from step (b)

d) electrolytic activation of the cleaned part by immersion of the part in a cyanide bath;

e) electrolytic deposition of a layer of nickel on the activated part obtained from step (d); and, f) deposition of a final, anti-wear layer of a material selected from the group consisting of Ag, Cr, Ni, Co, and mixtures of any two or more thereof, with or without ceramic particles such as SiC, $Cr_2C_3$, $Al_2O_3$, $Cr_2O_3$.

According to a preferred embodiment of the invention, step (b) comprises two successive sub-steps, ($b_1$) and ($b_2$), carried out in an inert gas atmosphere, the two sub-steps being:

$b_1$) ionic pickling of the substrate in a vacuum enclosure at a pressure between $1\times10^{-1}$ and 50 Pa; and $b_2$) nickelling the substrate by cathodic spraying in an inert atmosphere, obtained by the introduction of argon into the vacuum enclosure, at a pressure between $2\times10^{-1}$ and 5 Pa, preferably between 0.4 and 0.8 Pa.

Preferably the cathodic spraying of sub-step ($b_2$) is carried out with a magnetron cathode.

The invention also provides a coated part comprising a titanium based substrate; a first coating layer of nickel deposited on said substrate by magnetron cathode spraying to a thickness ranging from 3 to 7 microns; a second coating layer of nickel deposited electrolytically on said first layer by prenickelling in an acid bath followed by nickelling in a sulphamate bath, said second coating layer having a thickness between 18 and 20 microns; and a final, anti-wear coating layer deposited on said second layer and comprising a material selected from the group consisting of Ag, Cr, Ni, Co, and mixtures of any two or more thereof, with or without ceramic particles such as SiC, $Cr_2C_3$, $Al_2O_3$, $Cr_2O_3$, said final coating layer having a thickness in excess of 80 microns.

Other characteristics of the process in accordance with the invention will become apparent from the following description and the accompanying drawings.

DESCRIPTION OF THE PREFERRED EMBODIMENTS

Figure 1:
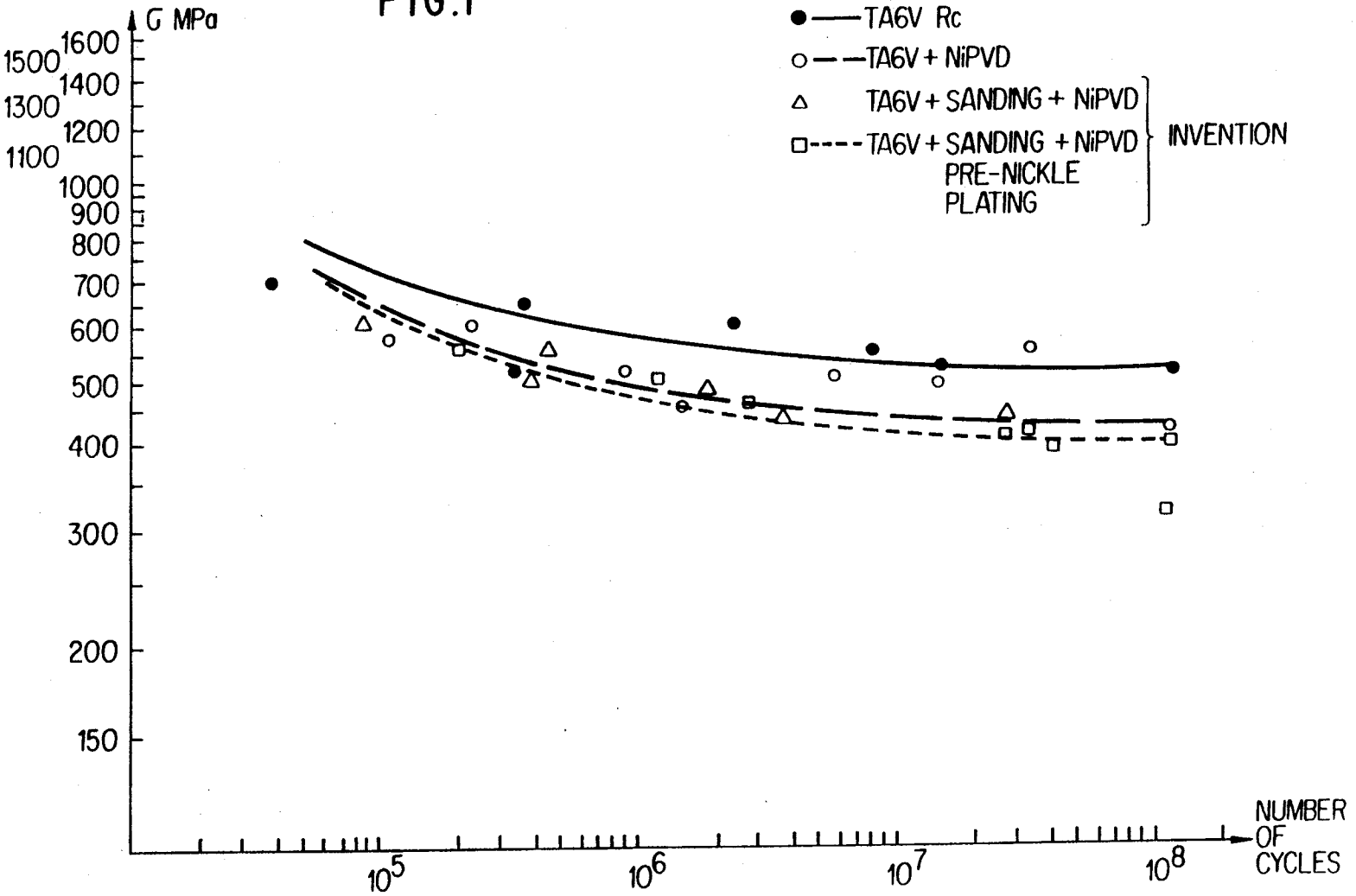
FIGS. 1 and 2 are graphs showing the results of rotary bending fatigue tests carried out on annular test pieces of TA6V treated in various different ways in accordance with the state of the art defined by FR-A-1 322 970 or in accordance with the invention, as indicated by the legends associated with the graphs, said graphs plotting the permissible rotary bending stresses against the number of cycles performed.

In the following description the steps of the process in accordance with the invention will be explained, by way of example, with reference to depositions carried out on test pieces of TA6V titanium alloy in the cast state. The test pieces used were as follows:

bars of 30 mm diameter and 80 mm height;
plates measuring 100×20×2 mm;
bars having drilled holes of 30 mm diameter and 12 mm depth.

The first step is a roughening of the substrate, e.g. by sanding in the dry state with 50 micron corundum or by wet sanding with quartz of 40 microns, an operation shown by tests to be desirable to obtain a satisfactory adherence of the subsequently deposited nickel.

The part is then placed in a vacuum enclosure at a high secondary vacuum, i.e. at a pressure between $3\times10^{-4}$ and $3\times10^{-1}$ Pa, and the substrate is subjected to ionic pickling which cleans the substrate by removal of matter. To do this, the part is placed in an inert gas atmosphere, for example argon injected into the enclosure at a pressure between $1\times10^{-1}$ and 50 Pa, while a negative voltage is applied to the substrate so as to attract the ions to the substrate during the luminescent discharge carried out in the enclosure. The operation may be carried out within a power density range of from 0.05 to 0.4 W/cm$^2$. Tests have shown that the preferred range is between 0.1 and 0.15 W/cm$^2$ for a perod of from 15 to 20 minutes.

After this ionic pickling operation the deposition of a keying layer of nickel on the substrate is effected. As mentioned earlier the method chosen for this deposition comprises cathodic spraying. This technique is a vacuum deposition process conducted in the cold state, in luminescent plasma, in a gas maintained at a reduced pressure of 0.1 to 10 Pa. The material to be deposited, nickel in this instance, is termed the target material and is introduced into the vacuum enclosure in the form of a plate of a few millimeters thickness, this being placed at the cathode position. The substrate is placed at the anode position.

At the residual pressure of the enclosure, the electric field created between the two electrodes gives rise to ionization of the residual gas which produces a luminescent cloud between the electrodes. The substrate then becomes covered with a layer of the same material as the target, due to the condensation of atoms originating from the target under the impact of positive ions contained in the luminescent gas and attracted by the target as a result of its negative polarization.

In preferred embodiments of the invention the deposition of the keying nickel is carried out by cathodic spraying with a magnetron cathode, so as to improve the quality of adherence of the nickel and increase the deposition rate to obtain an operating time compatible with the demands of industrial production.

With a magnetron cathode the electric field is combined with an intense magnetic field perpendicular to the electric field, that is to say parallel to the target. This superimposition of the two fields has the effect of winding the electron paths around the magnetic field lines, considerably increasing the chances of ionizing a gas molecule in the vicinity of the cathode. The ionization efficiency of the secondary electrons emitted by the cathode is increased as a result of the lengthening of their paths. This increase of ionic density in the proximity of the target brings about a substantial increase of the ionic bombardment of the latter, hence an increase of the quantity of atoms ejected for the same applied voltage.

Preferably the substrate to be coated, which is placed at the anode position, is polarized at a voltage between −20 and −500 V. The best results are obtained between −100 and −150 V.

The target is of pure nickel and is bombarded at a power density between 70 and 700 W/dm$^2$, the power density for the bombardment of the target being selected depending upon the temperature admissible by the substrate to be coated.

Spraying is carried out in an inert atmosphere within a pressure range of from 0.2 to 5 Pa, the best results being obtained between 0.4 and 0.8 Pa.

To obtain a nickel deposit of from 5 to 7 microns, an operation time between 45 and 60 minutes is sufficient, which constitutes an appreciable advantage over previously used techniques which require several hours.

The part then undergoes an alkaline immersion degreasing operation for from 3 to 7 minutes (typically 5 minutes) in an aqueous bath containing from 30 to 45 g/l of Turco 4215 NCLT or from 40 to 60 g/l Ardrox PST 39 (registered trade marks), followed by rinsing in cold water with monitoring of the water film continuity.

Electrolytic activation of the part is then effected by dipping it for one minute in an aqueous bath containing from 60 to 80/l KCN and from 10 to 50 g/l $K_2CO_3$ at a current density (c.d.) of from 1.5 to 3 A/dm$^2$.

The part is then further rinsed in cold water, after which an electrolytic nickelling operation is performed. This is carried out in two successive stages:

(1) prenickelling in an acid bath (pH=1.1) under the following operational conditions:
temperature: 50°±5° C.
current density: 6±1 A/dm$^2$ for 3 minutes, then 4±1 A/dm$^2$ for 10 minutes
in a bath containing:
$NiCl_2.6H_2O$: from 280 to 350 g/l
Ni metal: from 69 to 86 g/l
$H_3BO_3$: from 28 to 35 g/l The average deposited thickness is 15 microns, and the part is again rinsed in fresh water before the next stage.

(2) nickelling in a sulphamate bath under the following operational conditions:
temperature: 50°±5° C.
current density: 2 A/dm$^2$ for 5 minutes, then 4 A/dm$^2$ for 5 minutes
in a bath containing
Ni sulphamate: from 75 to 90 g/l
$NiCl_2$, $6H_2O$: 18 g/l
chloride ion Cl: from 3.75 to 5.60 g/l
$H_3BO_3$: from 30 to 40 g/l The thickness of nickel deposited ranges from 3 to 5 microns.

The part is then again rinsed in cold water before being given its anti-wear coating, for example of Cr, Ni-Co, Ni Co Sic or Ag-Ni.

As a first example, an electrolytic chromium coating may be obtained under the following working conditions:
temperature: 54°±1° C.
current density: 25 A/dm$^2$ for 10 minutes, then 20 A/dm$^2$ for 12 hours
in a bath containing:
$CrO_3$: from 225 to 275 g/l
$H_2SO_4$: from 2 to 3 g/l
$Cr^{+++}$: from 2.5 to 8 g/l
with the ratio $CrO_3/H_2SO_4$ being between 90 and 120.

The average thickness obtained is between 120 and 150 microns.

As a second example, an anti-wear coating of Ni-Co containing 29% Co may be obtained using a bath in which the Ni/Co mass ratio is 20 and the total Ni+Co in solution is 87.5 g/l.

The nickel and the cobalt are introduced into the bath in the form of nickel sulphamate Ni $(NH_2SO_3)_2$, $4H_2O$ and cobalt sulphamate Co $(NH_2SO_3)_2$, $4H_2O$, and are deposited under the following operational conditions:

temperature: 50°±2° C.

pH: 3.9±0.1 current density: 2 A/dm$^2$ for 10 minutes, then 4 A/dm$^2$ for 3 hours and 25 minutes.

The parts are placed on a rotary mounting and the bath stirred with compressed air.

The average coating thickness obtained is from 120 to 140 microns.

After receiving its anti-wear coating, the part is rinsed in cold water and then dried with compressed air, followed by degassing at 200°±5° C. for 3 hours.

In order to determine the fatigue resistance of titanium based parts coated with anti-wear deposits in accordance with the invention, rotary bending fatigue tests were conducted on annular test pieces.

For this purpose, test pieces coated in accordance with the invention were compared with test pieces coated according to the state of the art as taught by FR-A-1322970.

The tables included herein show the operations which were carried out.

Table 1 shows the treatment steps applied to 56 test pieces, some of which were left at various intermediate stages of the coating processes before subjecting them to the rotary bending fatigue tests.

Table 2 illustrates the precise operational conditions of the electrolysis carried out in the operations indicated in Table 1.

Figure 2:
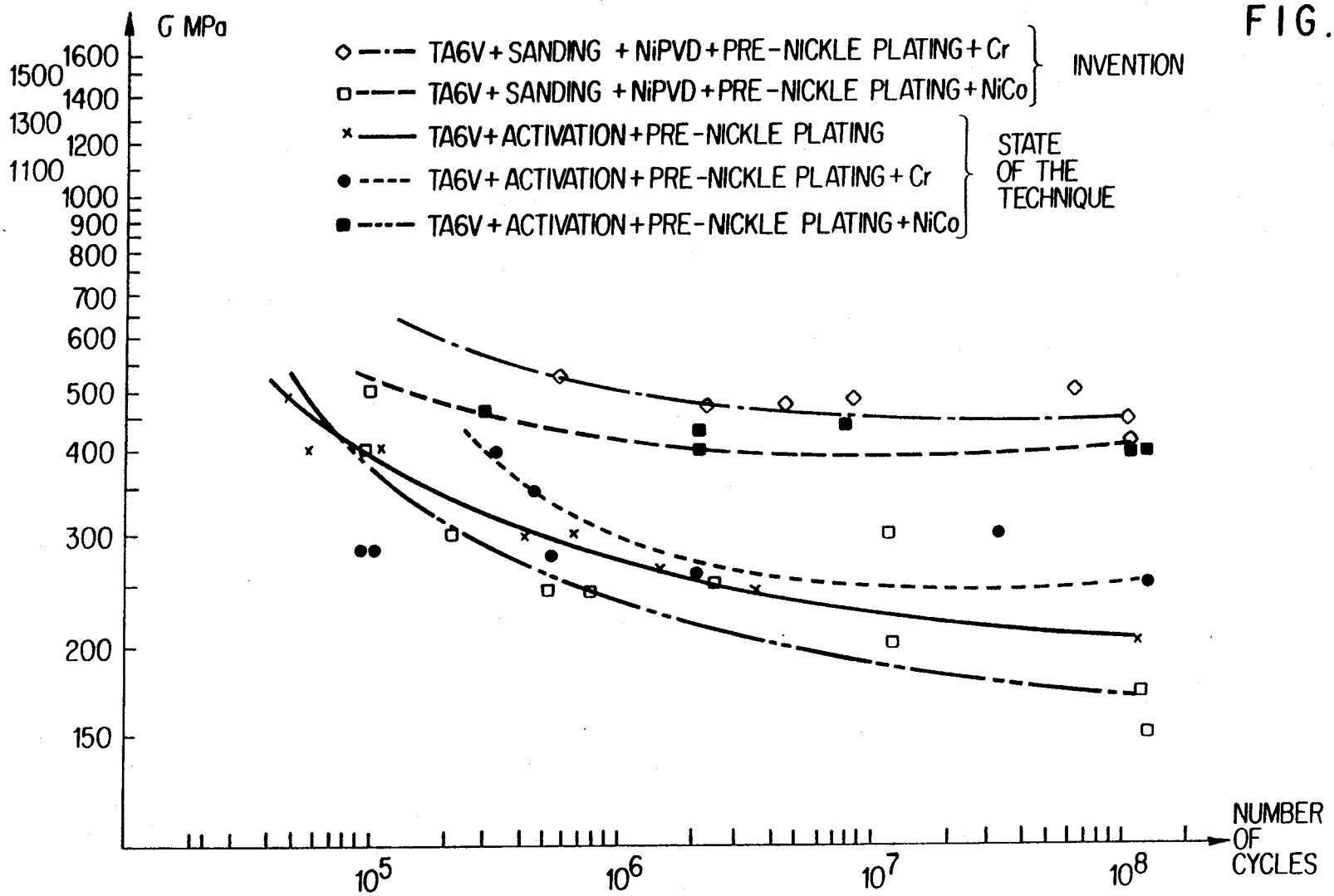

The curves of FIGS. 1 and 2 illustrate the results of the rotary bending fatigue tests, showing the variation of stresses as a function of the number of cycles according to the finished state of the parts, and depending on whether they were obtained by the invention or in accordance with the state of the art.

The curves show that the parts coated in accordance with the invention have a rotary bending fatigue failure rate much lower than those produced in accordance with the state of the art as illustrated by FR-A-1 322 970.

The permissible maximum stresses at the end of $10^8$ cycles can be summarized as shown in the following table depending on whether the coatings (nickelling alone, Ni Co, or Cr) were obtained in accordance with the invention or according to the state of the art:

| σ (MPa) | Substrate TA 6 V (ref.) | Prenickelling | Ni Co | Cr |
|---|---|---|---|---|
| STATE OF THE ART | 500 | 200 | 170 | 250 |
| INVENTION | 500 | 380 | 380 | 440 |

Table 3 shows the results of vibratory fatigue tests carried out on a number of samples, depending upon the nature of the treatment used for each sample, the number of cycles, and the maximum stresses applied.

TABLE 1

TREATMENT STEPS APPLIED IN THE CASE OF ROTARY BENDING FATIGUE TEST PIECES

| TEST PIECE REFERENCES | TREATMENT STEPS |
|---|---|
| 42-33-26-38-35-29-40 | Polished ground condition + Nickel PVD (1) |
| 64-65-66-67-68-69-70 | Dry sanding + Nickel PVD (1) |
| 50-51-52-53-54-55-56 | Dry sanding + Ni PVD + prenickelling pH = 1.1 + sulphamate nickelling (1) |
| 15-37-32-36-34-30-33 | Dry sanding + Ni PVD + prenickelling pH = 1.1 + sulphamate nickelling + nickel-cobalt (1) |
| 25-31-41-36-37-38-39 | as above + chromium (1) |
| 9-10-11-12-13-14-16 | Dry sanding + activation + prenickelling pH = 1.1 + sulphamate nickelling (2) |
| 57-58-59-60-61-62-63 | Same preparation steps + chromium (2) |
| 17-19-20-21-22-23-24 | As above + nickel-cobalt (2) |

(1) Steps in accordance with the invention (nickel PVD + electrolytic depositions)
(2) Steps in accordance with the state of the art (chemical preparation + galvanization)

TABLE 2

OPERATIONAL ELECTROLYSIS CONDITIONS (*) APPLIED TO THE ROTARY BENDING FATIGUE TEST PIECES

| | Steps according to the state of the art | | | | Steps in accordance with the invention | | | |
|---|---|---|---|---|---|---|---|---|
| BATHS | c.d. A/dm2 | I1 mA | I2 mA | duration minutes | c.d. A/dm2 | I1 mA | I2 mA | duration minutes |
| PRENICKELLING | 8 | 540 | 816 | 5 | 7 | 476 | 714 | 3 |
| pH = 1.1 | 4 | 272 | 408 | 10 | 4.5 | 306 | 459 | 10 |
| NICKEL-SULPHAMATE | 2 | 135 | 204 | 5 | 2 | 136 | 204 | 5 |
| | 4 | 272 | 408 | 5 | 4 | 272 | 408 | 5 |
| CHROMIUM | 40 | 2720 | 4080 | 10 | 25 | 1700 | 2550 | 10 |
| | 35 | 2400 | 3500 | 8h | 20 | 1360 | 2040 | 12h |
| NICKEL-COBALT | 2 | 135 | 204 | 10 | 2 | 135 | 204 | 10 |
| (29% cobalt) | 4 | 272 | 408 | 3h25 | 4 | 272 | 408 | 3h25 |

(*) Rotary mounting
I1 = 2 test pieces; I2 = 3 test pieces

TABLE 3

RESULTS OF VIBRATORY FATIGUE TESTS

| NATURE OF TREATMENT | Maximum stress $10^5$ cycles | Drop in Fatigue limit | Maximum stress $10^8$ cycles | Drop in Fatigue limit |
|---|---|---|---|---|
| (1) TA6V reference state | 600 MPa | / | 520 MPa | / |
| (2) Polished ground state + Nickel PVD (1) | 570 MPa | 5% | 420 MPa | 19% |
| (3) Dry sanding state + nickel PVD (1) | 550 MPa | 9% | 420 MPa | 19% |
| (4) Dry sanding + nickel PVD + pre- | 550 MPa | 9% | 400 MPa | 23% |

TABLE 3-continued

RESULTS OF VIBRATORY FATIGUE TESTS

| NATURE OF TREATMENT | Maximum stress $10^5$ cycles | Drop in Fatigue limit | Maximum stress $10^8$ cycles | Drop in Fatigue limit |
|---|---|---|---|---|
| nickelling + nickel sulphamate (1) | | | | |
| (5) Same as treatment (4) + nickel-cobalt 0.1 mm + 3 h 200° C. (1) | 480 MPa | 20% | 380 MPa | 27% |
| (6) Same as treatment (4) + chromium 0.1 mm + 3h 200° C. (1) | 520 MPa | 13% | 440 MPa | 15% |
| (7) Dry sanding + activation + pre-nickelling + nickel sulphamate (2) | 400 MPa | 33% | 200 MPa | 61% |
| (8) Same as treatment (7) + nickel-cobalt 0.1 mm + 3 h 200° C. (2) | 300 MPa | 50% | 170 MPa | 67% |
| (9) Same as treatment (7) + chromium 0.1 mm + 3h 200° C. (2) | 280 MPa | 53% | 250 MPa | 52% |

(1) Steps in accordance with the invention (nickel PVD + electrolytic depositions)
(2) Steps in accordance with the state of the art (chemical preparation + electrolytic depositions)

If a comparative analysis is made of the results of these tests on parts having a similar level of coating, depending on whether the coating is obtained in accordance with the invention or according to the state of the art, the following points may be seen:

The drop in fatigue limit after $10^8$ cycles of parts having undergone only the nickelling (thus without the final coating) is 61% if the part is obtained according to the state of the art, but only 23% if the part is obtained by nickel PVD, then electrolysis as proposed by the invention.

In the coated state, for 0.1 mm thick chromium coatings, the drop in fatigue limit is 52% for parts produced according to the state of the art and only 15% for the parts produced in accordance with the invention.

For 0.1 mm thick nickel-cobalt coatings, the difference is even greater as the drop in fatigue limit is 67% for parts coated according to the state of the art and 27% for the parts coated in accordance with the invention.

The results discussed above show that the invention enables the lowering of the fatigue limit to be appreciably limited for parts coated with protective deposits relative to the uncoated substrate, as regards both vibration fatigue and rotary bending fatigue.

Thus, by providing an industrially exploitable process (by virtue of its comparatively limited duration relative to the state of the art) for making reliable and durable anti-wear coatings on titanium alloy substrates, the invention enables coated titanium parts to be produced for use in restrictive environments where such parts could not previously be used.

It is therefore possible to use titanium substrates, which are very much lighter than the materials normally used, for parts subjected to lasting fatigue stresses, due both to rotary bending and to vibrations.

We claim:

1. A process for depositing an anti-wear coating on a titanium-based substrate, comprising the following steps:

a) roughening said substrate by sanding;

b) deposition of a keying nickel sub-layer on said roughened substrate by cathode sputtering;

c) intermediate cleaning of the part obtained from step (b);

d) electrolytic activation of the cleaned part by immersion of said part in a cyanide bath;

e) electrolytic deposition of a layer of nickel on the activated part obtained from step (d); and f) deposition of a final, anti-wear layer of a material selected from the group consisting of Ag, Cr, Ni, Co, and mixtures of any two or more thereof.

2. A process according to claim 1, wherein said final anti-wear layer deposited in step (f) includes ceramic particles.

3. A process according to claim 2, wherein said ceramic particles are selected from the group of SiC, $Cr_2C_3$, $Al_2O_3$ and $Cr_2O_3$.

4. A process according to claim 1, wherein step (b) comprises two successive sub-steps ($b_1$) and ($b_2$) comprising:

$b_1$) ionic pickling of said substrate in a vacuum enclosure at a pressure between $1\times10^{-1}$ and 50 Pa; and $b_2$) nickelling said substrate by cathode sputtering in an inert atmosphere obtained by the introduction of argon into said vacuum enclosure, at a pressure between $2\times10^{-1}$ and 5 Pa.

5. A process according to claim 4, wherein said sub-step ($b_2$) is carried out at a pressure between 0.4 and 0.8 Pa.

6. A process according to claim 4, wherein said sub-step ($b_2$) is carried out by cathode sputtering with a magnetron cathode.

7. A process according to claim 4, wherein said substrate is placed in the anode position and polarized at a voltage between −20 and −500 V.

8. A process according to claim 7, wherein said substrate is polarized at a voltage between −100 and −150 V.

9. A process according to claim 7, wherein the cathode target is of pure nickel and is bombarded with a power density between 70 and 700 W/dm$^2$, the power density for the bombardment of said target being selected according to the temperature admissible by said substrate to be coated.

10. A process according to claim 1, wherein said intermediate cleaning stage (c) comprises dipping said part in an alkaline bath for between 3 and 7 minutes, followed by rinsing said part in cold water.

11. A process according to claim 1, wherein step (e) comprises two successive sub-steps ($e_1$) and ($e_2$) comprising:

$e_1$) prenickelling said activated part in an acid bath at 50° C.±5° C., firstly at a current density of 6±1 A/dm$^2$ for 2 minutes and then at a current density of 4±1 A/dm$^2$ for 10 minutes; and $e_2$) nickelling said prenickelled part in a sulphamate bath at a current density between 2 and 4 A/dm$^2$ for 5 minutes.

12. A process according to claim 11, including a cold water rinsing step between each of said steps (d), ($e_1$), ($e_2$) and (f).

* * * * *